United States Patent [19]

Yost

[11] Patent Number: 4,705,242

[45] Date of Patent: Nov. 10, 1987

[54] UNIVERSAL GUTTER MOUNTING SYSTEM

[76] Inventor: George P. Yost, 102 Oswegatchie Rd., Waterford, Conn. 06385

[21] Appl. No.: 41,060

[22] Filed: Apr. 22, 1987

[51] Int. Cl.[4] ..... E04D 13/06

[52] U.S. Cl. ..... 248/48.1; 52/11

[58] Field of Search ..... 248/48.1, 48.2; 52/11, 52/15; 405/119

[56] References Cited

U.S. PATENT DOCUMENTS

| | | | |
|---|---|---|---|
| 357,839 | 2/1887 | List | 248/48.1 |
| 357,876 | 2/1887 | Taylor | 248/48.1 X |
| 384,985 | 6/1888 | Laurence | 248/48.1 |
| 1,558,385 | 10/1925 | Meunier | 248/48.1 |
| 2,631,801 | 3/1953 | Toal | 248/48.1 |
| 2,895,694 | 7/1959 | Graving et al. | 248/48.1 |
| 4,000,587 | 1/1977 | Weber | 248/48.1 X |

*Primary Examiner*—Ramon O. Ramirez

*Attorney, Agent, or Firm*—Albert W. Hilburger

[57] ABSTRACT

A universal mounting system for attaching replacement gutters to the roof of a building which has roof shingles already in place. It is particularly applicable in those instances in which an elongated hanger strap extends upwardly at longitudinally spaced locations along the length of commonly available gutter hardware. An elongated anchor plate is employed in conjunction with each hanger strap and has a width substantially greater than that of its associated hanger strap. In one instance, the anchor plate is folded about a transverse fold line so as to define a nailing pad and a support pad. An elongated, laterally extending, slot is formed adjacent the fold line to define a mounting strip between the slot and the fold line. The anchor plate is slipped under the roof shingles so as not to be visible and is positioned such that the slot is just exposed, then is attached to the roof by means of a nail piercing the nailing pad only. The support strap is threaded upwardly through the elongated slot, then bent around the mounting strip, first forwardly and then downwardly, any excess length thereof being cut off and discarded. The resultant connection between the support strap and the mounting strip on the anchor plate allows freedom of swinging movement of the gutter trough relative to the building.

10 Claims, 11 Drawing Figures

UNIVERSAL GUTTER MOUNTING SYSTEM

BACKGROUND OF THE INVENTION

I. FIELD OF THE INVENTION

The present invention relates to a system for attaching replacement gutters on a building and, particularly, to an improved system which can be used universally with gutter constructions in which the gutter trough is suspended from straps which extend upwardly at longitudinally spaced locations along the length of the gutter trough.

II. DESCRIPTION OF THE PRIOR ART

In modern building construction, there are four primary types of gutter installations. These include the spike and ferrule system the floating system, the sky hook, and the roof hanger. In more specific terms, the spike and ferrule is an installation in which an elongated spike is driven through the front upper edge of the gutter trough, through an elongated spacer tube or ferrule, through the rear upper edge of the gutter trough and into a vertically positioned fascia board. The floating system includes a strip, generally of aluminum sheet material, installed on the front face of the fascia board. The gutter trough is snapped into the strip. A support bar connects the front and rear inner edges of the gutter trough and the system is secured to the fascia board by means of a nail through the back of the gutter trough. The sky hook includes a bracket which hooks into the front edge of the gutter trough and presses against the back surface of the gutter trough. A shorter spike than in the instance of the spike and ferrule system is then driven from within the gutter trough through the rear of the gutter trough and into the fascia board such that the head of the spike is hidden from view.

Each of the installation systems just described is used in those instances in which the building to which the gutter is to be installed has a flat fascia board, generally vertically disposed and mounted beneath the eaves or roof overhang of the building to which the gutter is to be attached. The fourth, or roof hanger, system is used when a molded fascia board is present such that the gutter trough cannot be directly attached thereto.

The invention relates to the fourth category of gutter installation systems just described. As roof hanger systems have been used up to the present time, if the gutters are to be attached to the building and the roof shingles are not to be replaced, it is necessary to attach the hanger strap to the roof in such a manner that it overlies the roof shingles; then it is attached by means of a nail passing through a pre-formed hole in it. This is particularly objectionable since roof straps are needed to support the gutter trough at spaced locations along its length. As a result, in this kind of an installation, there are a plurality of parallel, longitudinally spaced, straps mounted to the roof and overlying the shingles which causes an objectionable appearance. Furthermore, the metal hangers are thereby subjected to the weather and, even though any steel components would initially be anodized or otherwise protected against rusting, with the passage of time, they would become rusted. Not only would the straps themselves thereby present an even more unsightly appearance, but there is the further undesirable result that rusty water descending down the side of the building from each hanger strap would carry with it particles of rust which, upon evaporation, would leave behind ugly rust scars on the side of the structure.

An additional drawback of the conventional roof hanger system occurs when the gutter trough is subjected to heavy loads for an extended period of time, ice in winter weather being a primary example. The combination of the ice load and movement of the trough as by wind causes an interaction between the strap and the roof shingle which tends to loosen the mounting fasteners.

Patents which are typical of the prior art in this field are U.S. Pat. Nos. 18,113 issued Sept. 1, 1857; 78,617 issued June 2, 1868; 347,348 issued Aug. 17, 1886; and 948,901 issued Feb. 8, 1910. In each of these instances, the bracket is pre-formed with holes to receive fasteners such as nails for attachment to the roof. Thus, in each instance, the bracket is hidden from view only if it is attached to the base roof structure before the overlying roof shingles are laid down. This is acceptable practice in the event of new construction in which the gutters are attached before the roof is laid down. It is also acceptable practice when the gutters are attached to a building with old roof shingles and in which new roof shingles are to be installed overlying the old roof shingles. However, in actual practice, such situations do not readily occur.

In earlier times, for example, it was customary for a single contractor to perform many different roles in the construction industry. In that instance, it could be readily arranged for the installation of the gutters to precede the laying down of the roof shingles. However, in the modern day, it is more customary than not that contractors who specialize in roofing do not specialize in gutter installations, and vice versa. Hence, it is often times necessary for the installation of the roof shingles to precede that of the gutters. The purpose of the invention is to assure an excellent and aesthetically pleasing installation in such an event.

Furthermore, in each of the prior patents noted above, mounting of the gutter trough is achieved by means of straps or bolts received within elongated slots which lie in a plane generally perpendicular to a plane containing the edge of the roof to which the gutter is being mounted. Such a construction results in a rigid installation which does not readily permit access to regions behind the gutter trough, as for painting and the like. Many of the systems known to the prior art were expensive to manufacture and install, and did not readily permit adjustment in the event it became necessary in the course of installation, or subsequently.

SUMMARY OF THE INVENTION

It was with knowledge of the prior art as just briefly described and the problems existing by reason thereof, which gave rise to the present invention.

According to the invention, a universal mounting system is provided for attaching replacement gutters to the roof of a building which has roof shingles already in place. It is particularly applicable in those instances in which an elongated hanger strap extends upwardly at longitudinally spaced locations along the length of commonly available gutter hardware. An elongated anchor plate is employed in conjunction with each hanger strap and has a width substantially greater than that of its associated hanger strap. In one instance, the anchor plate is folded about a transverse fold line so as to define major and minor pad members. An elongated, laterally extending slot is formed adjacent to the fold line to define a mounting strip between the slot and the fold line. The anchor plate is slipped under the roof shingles so as not to be visible and is positioned such that the slot is just exposed, then is attached to the roof by means of a nail piercing only the major pad. The support strap is inserted upwardly through the elongated slot, then bent forwardly around the mounting strip and then downwardly, any excess length thereof being cut off and discarded. The resulting connection between the support strap and the mounting strip on the anchor plate allows freedom of swinging movement of the gutter trough relative to the building.

There are numerous features of the invention and advantages that result from those features. It enables the installation of a gutter using standard roof hangers, which comprises the majority of those available in the market place, without the need to attach the hanger straps in an unsightly manner on top of the roof shingles.

By reason of the invention, the length of the hanger strap is effectively lengthened. This might be desirable for gutters that require a greater pitch than normal.

The anchor plate which is fastened to the roof structure and to which the hanger strap is attached acts as a flashing when the nail or other fastener is driven through the roof shingle and into the nailing portion thereof. Any water which penetrates around the head of the nail will flow onto the upper surface of the support pad and be caused to flow, by gravity, to the drip edge of the roof and into the gutter trough.

By reason of the invention, new roof shingles can be installed on a building without waiting for the gutters to be hung first, as was necessary in conventional practice.

The invention enables the gutter pitch to be changed after installation is completed in a simple manner without the necessity of removing any components which have already been fastened to the roof.

The invention enables installation of gutters in the easiest possible manner by a person of minimum skill using standard tools.

A particularly outstanding feature of the invention resides in its construction which permits hinged movement between the gutter trough and the building. This substantially reduces, even eliminates, metal fatigue and therefore possible breakage of hanger straps due to gutter movement when not completely or properly strapped into place. This construction also permits the gutter to be pivoted away from the building which may be desirable for ease of painting the fascia board or for any other required operations behind the gutter trough.

Other and further features, objects, advantages, and benefits of the invention will become apparent from the following description taken in conjunction with the following drawings. It is to be understood that both the foregoing general description and the following detailed description are exemplary and explanatory but not restrictive of the invention. The accompanying drawings which are incorporated in, and constitute a part of this invention, illustrate some of the embodiments of the invention and, together with the description, serve to explain the principles of the invention in general terms.

DESCRIPTION OF THE PREFERRED EMBODIMENT

Figure 1:
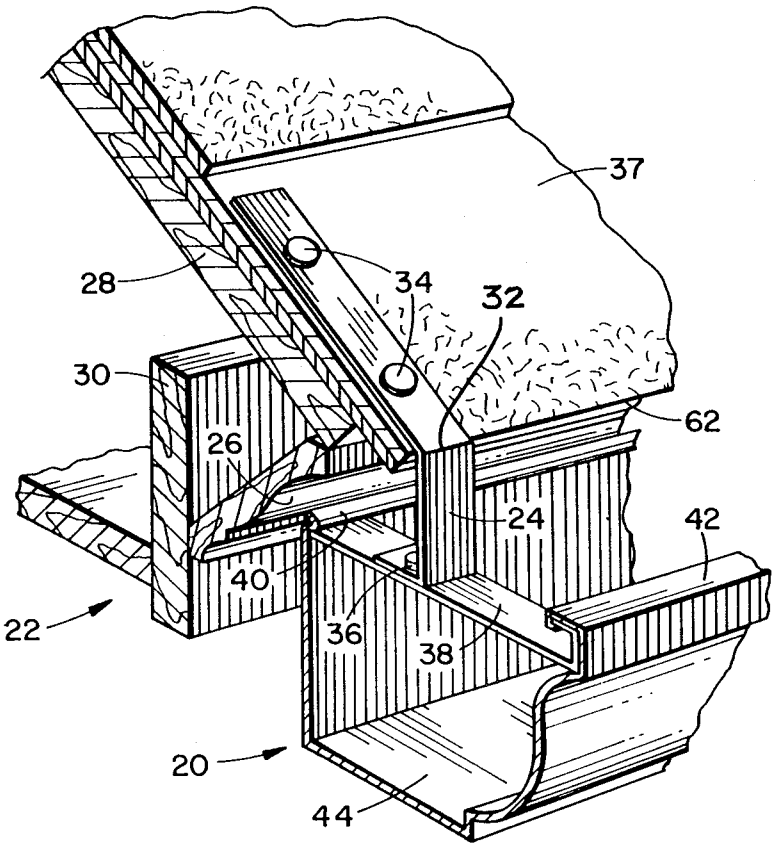
FIG. 1. PRIOR ART
FIG. 1 is a detail perspective view illustrating a prior art gutter installation.

Turn now to the drawings, and initially to FIG. 1 which is illustrative of a prior art installation of a gutter assembly 20 on a building 22 utilizing a conventional hanger strap 24. In the instance depicted in FIG. 1, a molded fascia board 26 is mounted for aesthetic reasons between roof sheathing 28 and a vertically disposed fascia board 30. Such a common construction prevents mounting of the gutter assembly 20 directly on the vertical fascia board 30 for obvious reasons.

In such a situation, it is normal procedure to bend the strap 24 at a bend line 32, then fasten the extreme end of the strap 24 to the roof structure overlying the roof shingle 37 by means of two or more nails 34 or other suitable fasteners. As is apparent from the drawing, that portion of the hanger strap 24 above the bend line 32 overlying the a roof shingle 37 causes an unsightly appearance.

In typical fashion, the lower end of the hanger strap 24 is pivotly mounted as by a rivot 36 to a cross strap 38 which is suitably attached at its upper ends to the opposite rims 40 and 42 of a gutter trough 44.

The gutter assembly 20 which, as seen, comprises the gutter trough 44, a plurality of cross straps 38 at spaced longitudinal locations along the trough, and associated hanger straps 24 pivotally mounted to each of the cross straps, is mounted to the roof of the building 22 by means of the hanger straps 24 and associated fasteners 34 in the manner just described. The bend line 32 for each strap 24 is determined by the installer who determines an appropriate slope for the gutter trough 44 to assure the proper flow of water to an associated downspout (not shown). It is noteworthy that the gutter assembly 20 comprising the gutter trough 44, cross straps 38, and associated hanger straps 24 are normally sold as a package to installation contractors.

Figure 2:
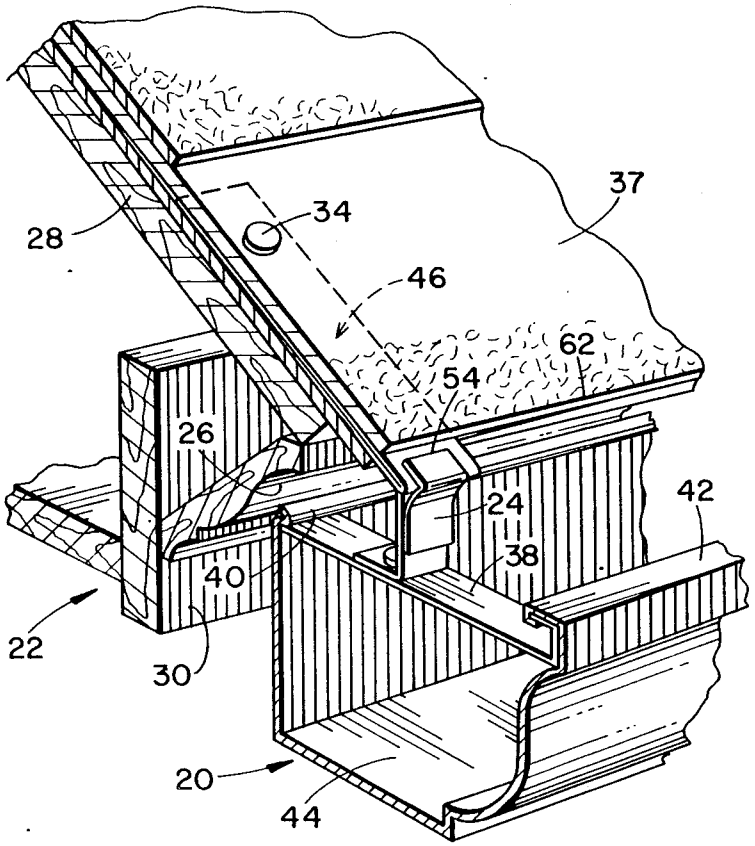
FIG. 2 is a detail perspective view, similar to FIG. 1, illustrating a gutter installation according to the invention.
Figure 3:
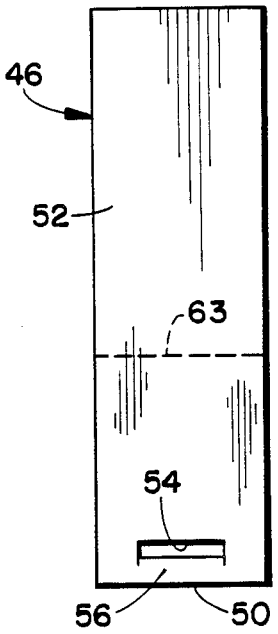
FIGS. 3, 4, and 5 illustrate top plan, bottom plan, and side elevation views, respectively, of a primary component of the invention.
Figure 4:
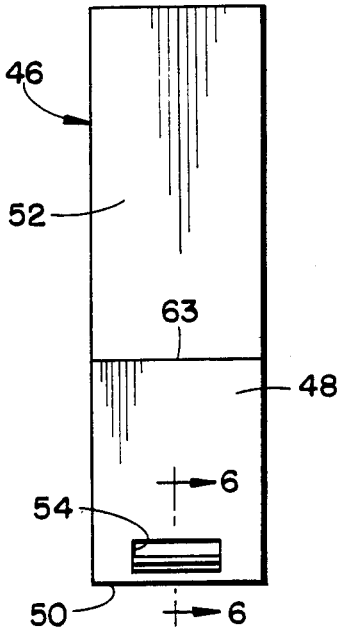
Figure 5:
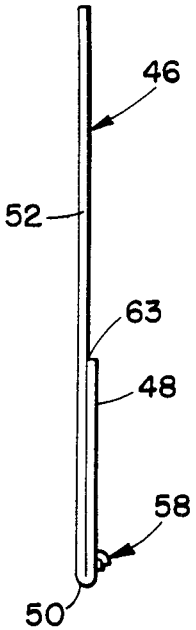
Figure 6:
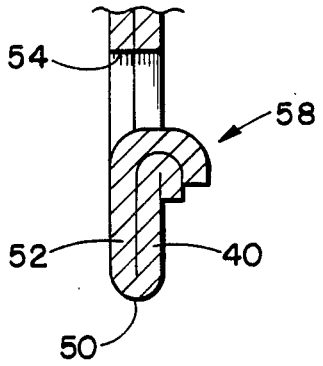
FIG. 6 is a detail cross section view taken generally along line 6—6 in FIG. 4.

Turn now to FIG. 2 which illustrates a completed installation in accordance with the invention and to FIGS. 3–5 which illustrate an elongated anchor plate 46 which is a primary component of the invention. The anchor plate 46 is typically fabricated of 0.032 inch thick aluminum, is approximately one and one half inches wide and seven inches long. Of course, it will be appreciated that the anchor plate 46 may be composed of other metals or even of plastic materials and its dimensions may vary from those just recited. In any event, as seen especially in FIGS. 3-5, a minor or support pad 48 is folded about a fold line 50 so as to lie in a contiguous relationship with a major or nailing pad 52 (see FIG. 5). In the configuration assumed in FIGS. 3-5, the anchor plate 46 may be, for example, five inches long and the folded over support pad 48 two inches long. As previously, these are typical dimensions and are not intended to be restrictive of the invention. In any event, it is preferable that the anchor plate 46 be rectangular for ease of manufacture and subsequent installation. In such a construction, the fold line 50 is perpendicular to the longitudinal edges of the anchor plate 46.

Thereupon, an elongated slot 54 is suitably formed at a location spaced from the fold line 50 and generally parallel thereto and generally intermediate of the opposite parallel longitudinal edges of the anchor plate so as to define a mounting strip 56 lying between the fold line 50 and the slot 54. It will be appreciated that by reason of the fact that the slot 54 is formed through two thicknesses of metal, the turned over portions collectively referred to by a reference numeral 58 lend additional strength to the mounting strip 56 which is beneficial in a manner to be described below. The slot 54 is formed so as to be slightly larger in its dimensions than the cross sectional dimensions of the hanger straps 24 and is typically three quarters of an inch wide and one eighth of an inch high. In any event, while not critical to the invention, dimensions are chosen so that there is substantial freedom of movement of a hanger strap received through the slot 54 in a manner to be described.

Figure 7:
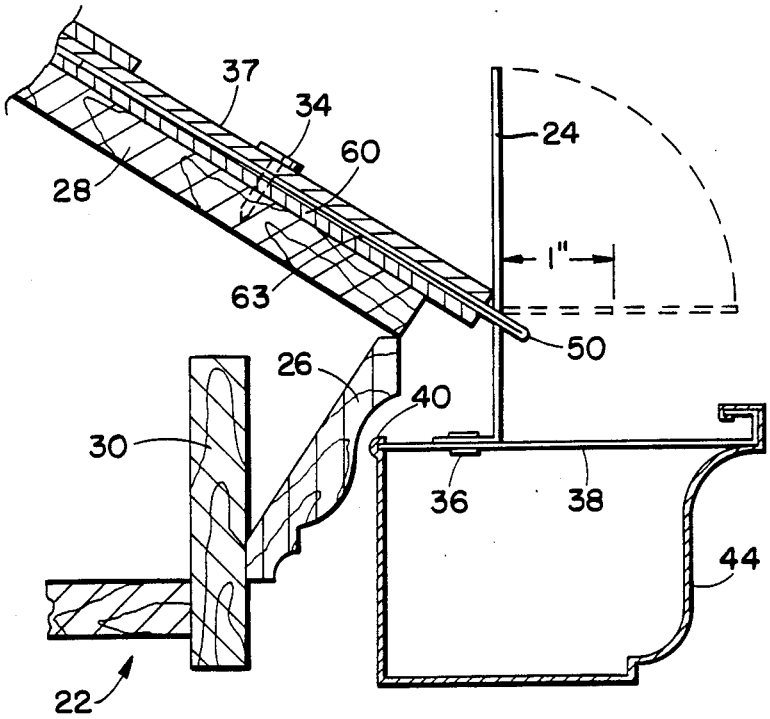
FIGS. 7 and 8 are detail side elevation views illustrating successive steps in the installation method of the invention.
Figure 8:
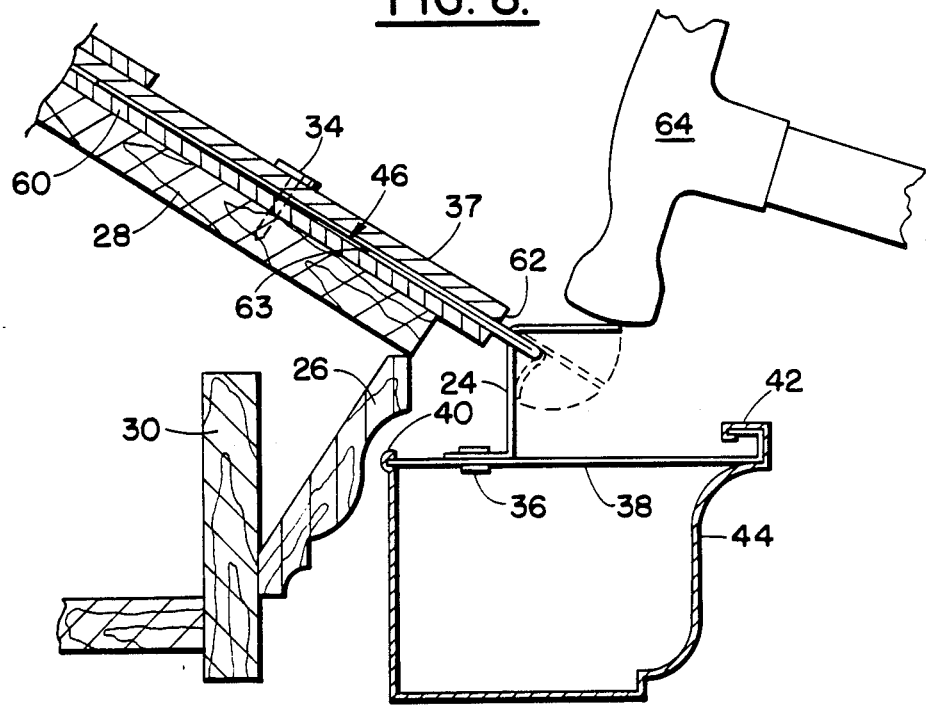

Turn now to FIGS. 7 and 8 for a description of the installation of a gutter assembly 20 in accordance with the invention. As an initial step, an anchor plate 46 is slid edgewise between an outer most roof shingle 37 and its underlayer 60 which may be, for example, tar paper. The anchor plate 46 continues to be slid between roof shingle 37 and the underlayer 60 until the slot 54 is immediately adjacent a drip edge 62, that is, the lowermost and forwardmost edge of the roof shingle 37 (see especially FIG. 2). A suitable fastener such as a single nail 34, in contrast to the use of two or more nails required in the prior art example (FIG. 1), is then used to attach the anchor plate 46 to the roof. Two or more nails are needed in the prior art system to accommodate not only the weight of the gutter trough but also the bending moment present at the bend line 32.

The anchor plate 46 is sufficiently wide that the installer is able to hammer the nail 34 through the roof shingle 37 and know that he will pierce the anchor plate 46 in the single thickness region thereof, that is, through the nailing pad 52 and above a terminal edge 63 (see especially FIGS. 7 and 8) of the support pad 48. The thickness of the nailing pad 52, as previously mentioned, is so chosen as to be able to be pierced by a suitable fastner such as a roofing or siding nail, or screw. For purposes of aesthetics, the head of the roofing nail 34 is preferably chosen to be of substantially the same color as that of the roof shingle 37.

Thereupon, as seen in FIG. 7, the hanger strap 24 is inserted through the slot 54 until the gutter trough 44 is at a desired height relative to the building 22. When the desired height of the trough 44 is achieved, the free end of the hanger strap 24 is bent forwardly and downwardly about the mounting strip 56 to approximately the horizontal position as illustrated in FIG. 7. An excess of the free end of the hanger strap 24 is then severed, as by hand shears, and discarded. A desirable length of the hanger strap 24 to retain in the horizontal position depicted in FIG. 7 is typically one inch, although various other lengths may be desirable. For example, a greater length will enable the lowering of the gutter trough 44 at some future time should that be desired. After the free end of the hanger strap 24 has been removed, a hammer 64 or other suitable tool may be used to bend the newly formed free end of the hanger strap 24 around the mounting strip 56 (see especially FIGS. 2 and 8), thereby suspending the trough 44 from the support pad 46.

This same procedure is performed at each longitudinally spaced location at which a cross strap 38 and associated hanger strap 24 is located along the length of the gutter trough 44. The free end of subsequent hanger straps 24, that is, at locations downstream from an initial strap 24, may be cut so as to be somewhat longer than the strap 24 to permit the trough 44 to have the proper pitch to assure flow of water toward a downspout.

Figure 9:
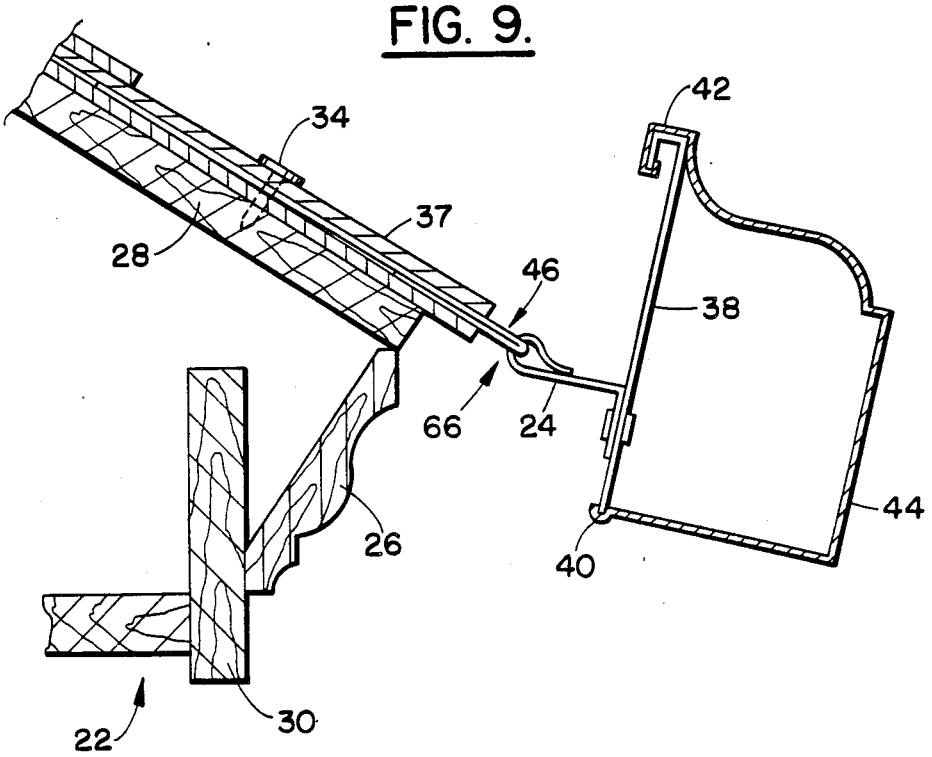
FIG. 9 is a detail side elevation view, similar to FIGS. 7 and 8, illustrating a completed gutter installation according to the invention, and specifically depicting the ability of a gutter trough to swing forwardly away from the building.

It will be appreciated that the construction just described and, specifically, the connection between the hanger strap 24 and the anchor plate 46, define a hinge 66 (FIG. 9) which enables pivoting movement of the gutter trough 44. Such a construction may be of substantial value should it be desirable to swing the gutter trough 44 forwardly (that is, in a counterclockwise direction as seen in FIG. 9) for easier painting of the fascia board 26, or for some other desirable reason.

Figure 10:
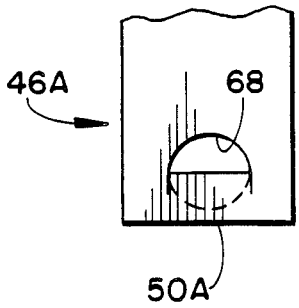
FIG. 10 is a detail top plan view, similar in part to FIG. 3, illustrating another embodiment of the invention.
Figure 11:
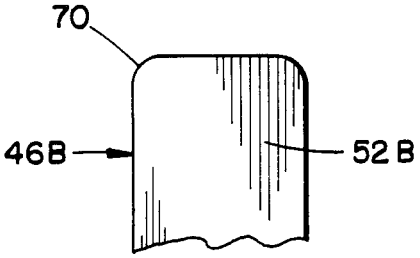
FIG. 11 is another detail top plan view, similar in part to FIG. 3, illustrating still another embodiment of the invention.

It was previously mentioned that the slot 54 must be sufficiently large to accommodate freedom of movement of the hanger strap 24 when it is inserted therethrough. It will be appreciated, as seen in FIG. 10, that slots of other shapes may be used. In FIG. 10, such a variation is depicted by a slot 68 formed in an anchor plate 46A adjacent a fold line 50. In this instance the slot 68 is seen to be half circular in shape, but the invention is not to be restricted to any particular shape. Rather, the slot 68 is only presented as one possible alternative shape for the slot 54.

In another embodiment, it may be desirable to round the corners of the nailing pad 52B of a modified anchor plate 46B as indicated at 70. This construction would eliminate the sharp corners as illustrated in FIGS. 3 and 4 to prevent the anchor plate from snagging on a roof shingle as it is inserted into position for mounting.

While a preferred embodiment of the invention has been disclosed in detail, it should be understood by those skilled in the art that various other modifications may be made to the illustrated embodiment without departing from the scope of the invention as described in the specification and defined in the appended claims.

What is claimed is:

1. A method of attaching gutters to a building adjacent the eaves thereof in those instances in which an elongated hanger strap extends upwardly from the gutter structure to which it is connected, comprising the steps of:

providing an elongated anchor plate having first and second spaced ends and a width substantially greater than that of the elongated strap;

forming an elongated slot adjacent the first end of the anchor plate and generally parallel thereto thereby defining a mounting strip between the first end and the slot;

sliding the anchor plate between the outermost roof shingle and the next underlayer until the first end is positioned adjacent the roof line with the slot exposed;

fastening the anchor plate to the roof at a location adjacent the second end;

inserting the hanger strap through the slot until the gutter reaches a selected height relative to the eaves; and bending the hanger strap around the mounting strip, first forwardly, then downwardly;

thereby allowing freedom of swinging movement of the hanger strap on the mounting strip.

2. A method of attaching gutters as set forth in claim 1 including the step, after the last recited step, of:

removing from the free end of the hanger strap an excess length thereof beginning at a location spaced below the mounting strip.

3. A method of attaching gutters to a building adjacent the eaves thereof in those instances in which an elongated hanger strap extends upwardly from the gutter structure to which it is connected, comprising the steps of:

providing an elongated anchor plate having first and second spaced ends and a width substantially greater than that of the elongated strap;

marking out a transversely extending fold line intermediate the first and second ends to thereby define a nailing pad lying between the second end and the fold line and a support pad lying between the fold line and the first end;

folding the support pad about the fold line until it is contiguous with the nailing pad;

forming an elongated slot through the major and minor pad members adjacent the fold line and generally parallel thereto thereby defining a mounting strip between the fold lien and the slot;

sliding the anchor plate between the outermost roof shingle and the next underlayer until the fold line is positioned adjacent the roof line with the slot exposed;

joining the anchor plate to the roof at a location adjacent the second end;

inserting the hanger strap through the slot until the gutter reaches a selected height relative to the eaves; and bending the hanger strap about the mounting strip, first forwardly, then downwardly;

thereby allowing freedom of swinging movement of the hanger strap on the mounting strip.

4. A method of attaching gutters as set forth in claim 3 including the step, after the last recited step, of;

removing from the free end of the hanger strap an excess length thereof beginning at a location spaced below the mounting strip.

5. A universal system for attaching gutters to a building adjacent the eaves thereof, in those instances in which an elongated support strap extends upwardly from the gutter structure, the combination comprising:

an elongated anchor plate having a width substantially greater than that of the elongated strap and including integral major and minor pad members in contiguous relationship, having been folded about a transversely extending fold line such that said major pad member overlies said minor pad member, and having an elongated slot adjacent the fold line to define a mounting strip between the slot and the fold line, said anchor plate being slidably receivable between the outermost roof shingle and the next underlayer;

said major pad member capable of receiving therethrough fastener means at a location distant from said minor pad member for joining said support pad to the roof of the building such that the slot extends generally parallel to and adjacent the roof line at the eaves of the building;

the slot being capable of receiving the hanger strap therethrough until the gutter reaches a selected height relative to the eaves, at which point, the hanger strap is bent about said mounting strip, first forwardly, then downwardly, thereby allowing freedom of swinging movement of the hanger strap on said mounting strip.

6. A universal system as set forth in claim 5 wherein said anchor plate is generally rectangular in shape, having substantially parallel edges; and wherein said fold line is perpendicular to said edges.

7. A universal system as set forth in claim 6 wherein the slot is generally equidistant from said edges.

8. A universal system as set forth in claim 5 wherein the slot is generally rectangular in shape.

9. A universal system as set forth in claim 5 wherein the slot is generally semi-circular in shape.

10. A universal system as set forth in claim 5 wherein said fastener means is a nail; and wherein said elongated anchor plate is comprised of sheet material having sufficient thickness to support the gutter yet being sufficiently thin to be pierced by the nail.

* * * * *